US005759270A

United States Patent [19]

Lee

[11] Patent Number: 5,759,270

[45] Date of Patent: Jun. 2, 1998

[54] CORRECTION TAPE ADHESIVER FOR CORRECTING MISTYPED LETTERS

[75] Inventor: Jung Ho Lee, Inchon, Rep. of Korea

[73] Assignee: Katsuyuki Miyazaki, Amagasak Hyogo, Japan

[21] Appl. No.: 758,730

[22] Filed: Dec. 3, 1996

[30] Foreign Application Priority Data

Feb. 29, 1996 [KR] Rep. of Korea ..... 1996-3726
Sep. 6, 1996 [KR] Rep. of Korea ..... 1996-28485

[51] Int. Cl.[6] ..... B05C 1/14

[52] U.S. Cl. ..... 118/257; 118/200; 156/577; 156/579; 400/695; 400/696; 400/700; 242/538.1

[58] Field of Search ..... 118/200, 257; 400/695, 696, 700; 156/577, 579; 242/538.1, 538.3

[56] References Cited

U.S. PATENT DOCUMENTS 5,379,477 1/1995 Tamai et al. ..... 15/104.94
5,556,469 9/1996 Koyama et al. ..... 118/257

*Primary Examiner*—Donald E. Czaja
*Assistant Examiner*—Michael P. Colaianni
*Attorney, Agent, or Firm*—Irving M. Fishman

[57] ABSTRACT

This invention relates to a correction tape adhesiver for correcting a mistyped letter comprising a rotatable tape guider which may turn its direction according to the gripping posture and/or using direction of the user. Said tape guider is formed separately from the case at the backside edge thereof and combined with the guide sill so as to ensure rotation of the tape guider to the certain extent.

4 Claims, 5 Drawing Sheets

CORRECTION TAPE ADHESIVER FOR CORRECTING MISTYPED LETTERS

FIELD OF THE INVENTION

The present invention relates to a correction tape adhesiver for correcting mistyped letters by attaching white correction tape on the letter, more particularly to a rotatable tape guider which may change the direction thereof according to the gripping posture and/or using direction of user.

BACKGROUND OF THE INVENTION

Generally, a correction tape adhesiver contains a supply reel, a winding reel and a roll of correction tape within a case. When the correction tape adhesiver is used, correction tape is reeled off from the supply reel through the tape guider projected from an edge of the case. As the tape guider is drawn on paper, coated material on the correction tape is attached on the mistyped letter so that the mistyped letter can be covered.

However, the aforesaid correction tape adhesiver of which tape guider is fixed in parallel or vertical direction with the case, is inconvenient to use because the user always had to turn his body or his wrist to ensure close contact between the tape guider and paper.

BRIEF DESCRIPTION OF THE INVENTION

The object of the present invention is to provide a correction tape adhesiver for correcting mistyped letters which solves the above mentioned drawback. To achieve this object the present invention provides a rotatable tape guider so as to closely contact with paper in regardless of he user's gripping posture or using direction.

The present invention will be explained in more detail below in reference to the attached drawings.

DETAILED DESCRIPTION OF THE EMBODIMENT

Figure 1:
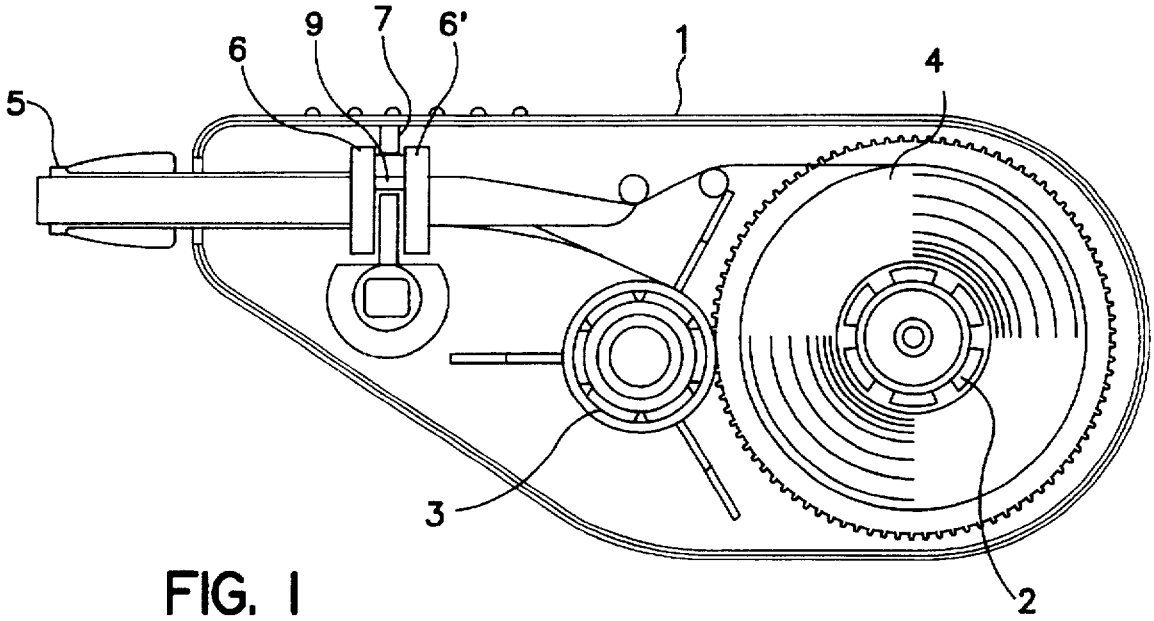
FIG. 1 is a schematic view of the present invention.

As shown in FIG. 1, present correction tape adhesiver contains a supply reel(2), a winding reel(3) and a roll of correction tape(4) within the case(1). When the present correction tape adhesiver is used, correction tape(4) winded on the said supply reel(2) is reeled off from the supply reel(2) passing through the tape guider(5) and then rewinded on the winding reel (3).

The tape guider is formed separately from the case(1), and provided with two rotation guides(6,6') at the backside thereof, wherein said rotation guides are combined with the guide sill(10) of the case(1) so that the tape guider(5) may turn to the certain extent under control of the rotation control means.

Figure 4A:
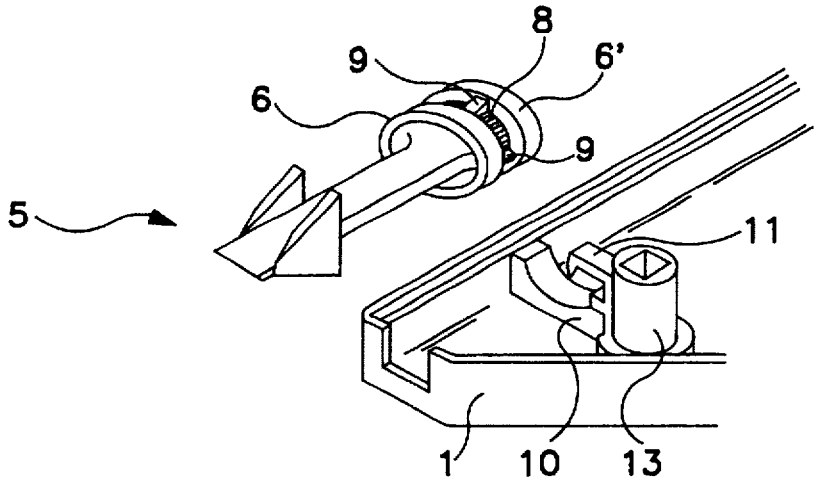
FIG. 4*a* is an exploded perspective view of rotation control means according to the present invention.
Figure 4B:
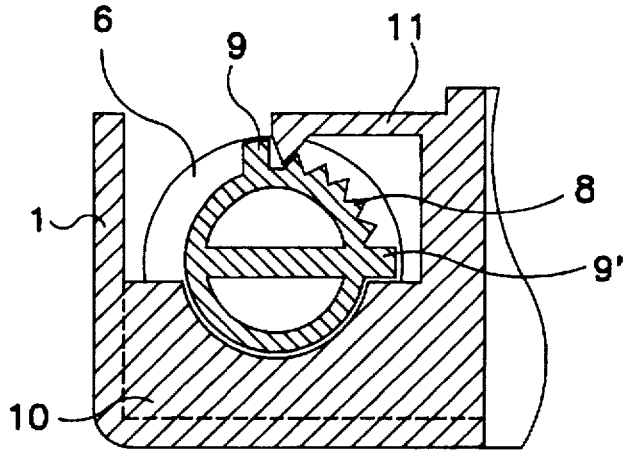
FIG. 4*b* is a cross-sectional view of FIG. 4*a*.

As shown in FIG. 4, said control means consists of two stoppers(9,9') and a saw-toothed portion(8) formed around the pivot axis at the backside of the tape guider(5). The saw-toothed portion is controlled by a resilient member(11) which is controlling the rotation of the pivot axis inside the case(1). The stoppers are arranged with an angle of 90° against each other.

Figure 5A:
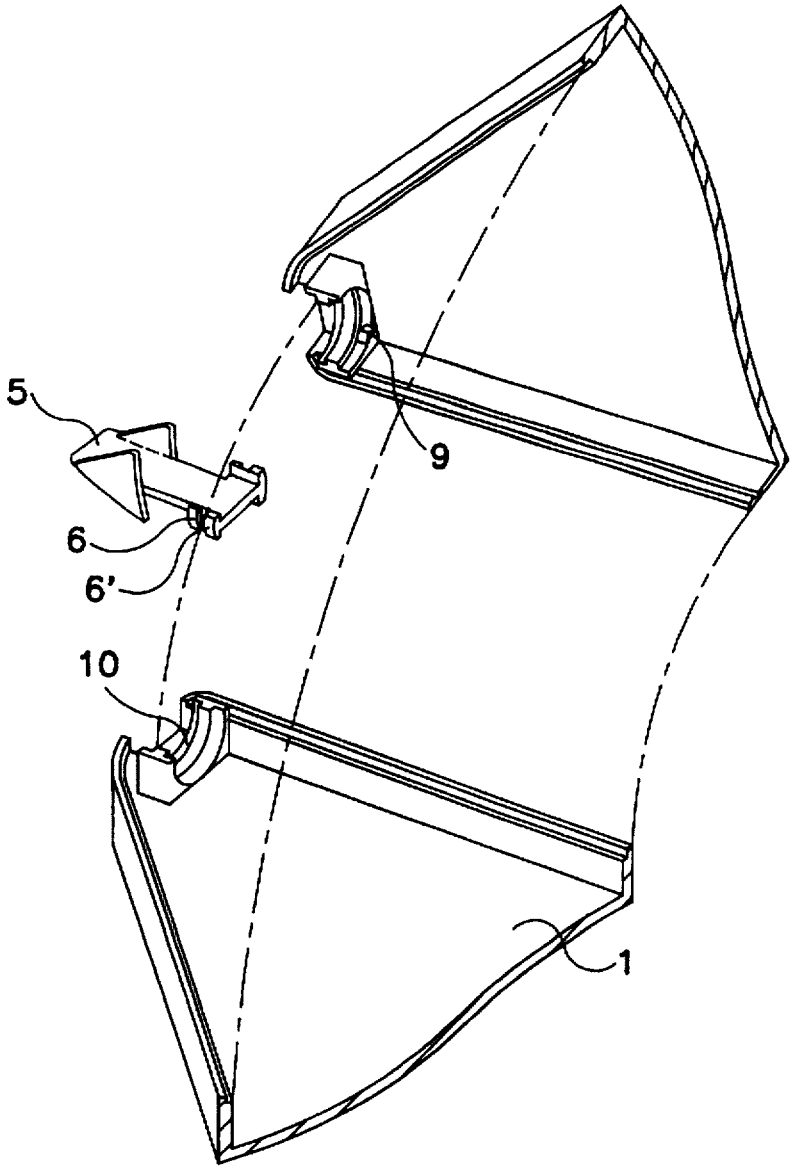
FIG. 5*a* is an exploded perspective view of an another embodiment of rotation control means according to the present invention.
Figure 5B:
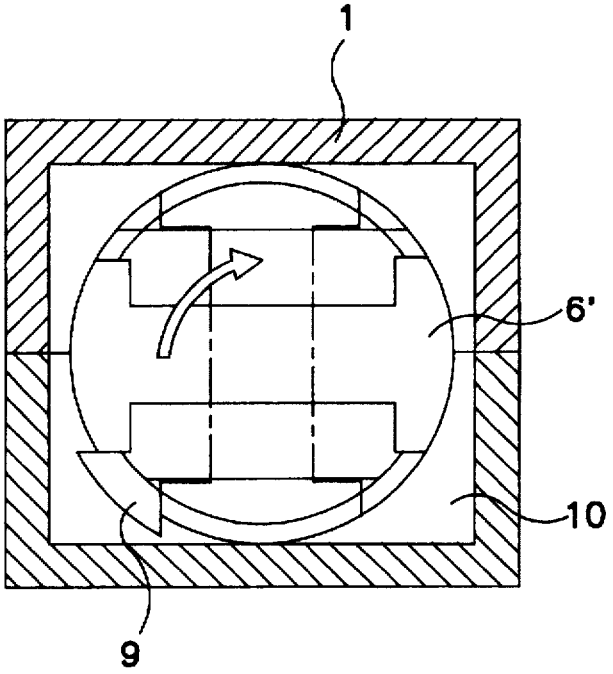
FIG. 5*b* is a cross-sectional view of FIG. 5*a*.

Also, as shown in FIG. 5, each of the rotation guide has a "H" shape cross-section and the stoppers(9,9') are formed at the guide sill(10) of the case(1) to limit the rotation range of the tape guider.

Reference number 12 indicates coated material on the correction tape, and reference number 13 indicates the combining boss.

When a user uses the correction tape adhesiver for correcting mistyped letter, like the known correction tape adhesiver, as the user draws the tape guider on a string of the mistyped letters, the correction tape wound on the supply reel is reeled off passing through the tape guider, and then rewound on the winding reel. During this operation, the white and non-transparent material coated on the correction tape(4) is attached on the mistyped letter on the paper and consequently the mistyped letter is covered.

Figure 2:
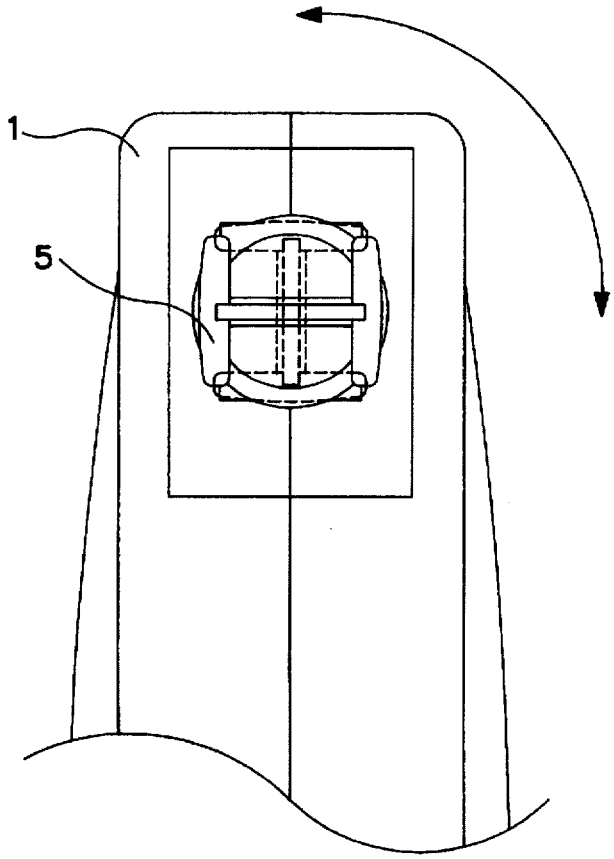
FIG. 2 illustrates rotating operation of a tape guider.
Figure 3A:
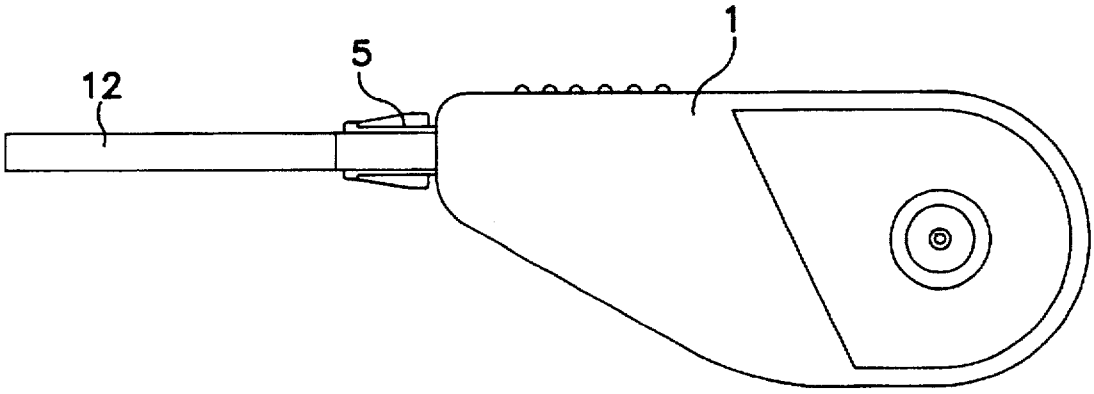
FIG. 3*a* illustrates working state of the tape guider when the tape guider is formed in parallel with the case.
Figure 3B:
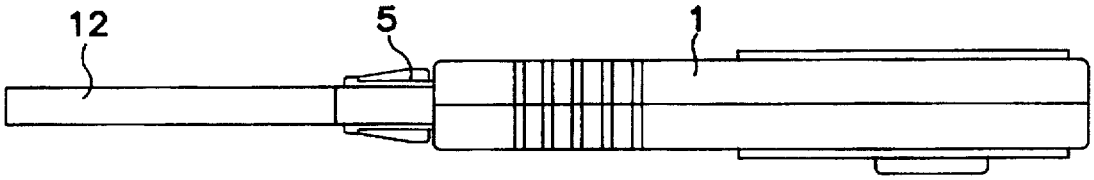
FIG. 3*b* illustrates working state of the tape guider when the tape guider is formed in perpendicular to the case with intersecting thereof.

When in many situations, the user doesn't have a good posture to closely contact the tape guider with the paper, for example the tape guider(5) is formed vertically with the case(1) while a string of mistyped letters is lying horizontally, or the tape guider(5) is formed in parallel with the case(1) while a string of mistyped letters is lying in vertical. In these cases, according to the invention, the tape guider is rotated within the range of 90°, which is determined by the stoppers(9,9') corresponding to the direction of the mistyped letter string, while the rotation of the pivot axis(7) is controlled by the saw-toothed portion(8) and the resilient member(11) as shown in FIG. 2. Consequently, since the tape guider may change the direction thereof, present correction tape adhesiver may be used conveniently as shown in FIG. 3.

Correction tape adhesiver for correcting the mistyped letters according to the present invention is provided with a tape guider which may rotate leftward or rightward within an angle of 90° so that the user may use it in a convenient posture regardless of gripping posture and/or direction of the word string.

I claim:

1. A correction tape adhesiver comprising:

a case (1);

a supply reel (2), a winding reel (3), and a roll of correction tape (4) within said case;

a tape guider (5) formed at ana edge of, but separately from, said case (1) and having a rear portion contained within said case (1); and a guide sill, (10);

said adhesiver for covering mistyped letters by rolling correction tape (4) onto paper bearing said mistyped letters in which said correction tape (4) is reeled off said roll from said supply reel (2), through said tape guider (5), and rewound onto said winding reel (3);

said adhesiver further characterized in that said tape guider (5) is provided with two rotation guides (6,6') at said rear portion thereof;

said adhesiver further comprising a rotation control means;

said rotation guides (6,6') in combination with said guide sill (10) and said rotation control means permitting rotation of said tape guider (5) within a set range.

2. The correction tape adhesive of claim 1 wherein said tape guider (5) has a pivot axis at said rear portion thereof;

said rotation control means consisting of stoppers (9,9') and a saw-toothed portion (8) provided around said pivot axis of said tape guider (5) and a resilient member (11) for controlling said saw-toothed portion (8), said resilient member (11) being inside said case (1), to limit the rotation of said tape guider (5).

3. The correction tape adhesiver of claim 1, wherein each of said rotation guides (6,6') has an "H" shaped cross-section and said stoppers (9,9') are mounted on said guide sill (10) of said case so as to limit the rotation of said tape guider (5).

4. The correction tape adhesiver of claim 2 or 3 wherein said stoppers (9,9') are arranged so as to limit the rotation of said tape guider (5) within an angular range of 90° leftward or rightward.

* * * * *